US010117520B2

(12) United States Patent
Franqui

(10) Patent No.: US 10,117,520 B2
(45) Date of Patent: Nov. 6, 2018

(54) PORTABLE BEACH CHAIR

(71) Applicant: Elizabeth Franqui, Bronx, NY (US)

(72) Inventor: Elizabeth Franqui, Bronx, NY (US)

( * ) Notice: Subject to any disclaimer, the term of this patent is extended or adjusted under 35 U.S.C. 154(b) by 0 days.

(21) Appl. No.: 15/484,114

(22) Filed: Apr. 10, 2017

(65) Prior Publication Data

US 2017/0290435 A1 Oct. 12, 2017

Related U.S. Application Data

(60) Provisional application No. 62/319,979, filed on Apr. 8, 2016.

(51) Int. Cl.

| | |
|---|---|
| ***A47C 7/74*** | (2006.01) |
| ***A47C 1/14*** | (2006.01) |
| ***A47C 4/00*** | (2006.01) |
| ***A47C 7/68*** | (2006.01) |
| ***A47C 7/50*** | (2006.01) |
| ***A47C 7/00*** | (2006.01) |

(52) U.S. Cl.

CPC ..... *A47C 7/744* (2013.01); *A47C 1/143* (2013.01); *A47C 4/00* (2013.01); *A47C 7/006* (2013.01); *A47C 7/506* (2013.01); *A47C 7/68* (2013.01)

(58) Field of Classification Search

CPC ..... A47C 7/744; A47C 4/00; A47C 7/006; A47C 7/506; A47C 7/68; A47C 1/143

USPC ..... 297/180.15

See application file for complete search history.

(56) References Cited

U.S. PATENT DOCUMENTS

| | | | | |
|---|---|---|---|---|
| 4,765,542 A * | 8/1988 | Carlson | A47C 7/74 | 297/180.15 X |
| 4,846,525 A * | 7/1989 | Manning | A47C 1/14 | 297/180.15 X |
| 5,641,197 A * | 6/1997 | Springmann | A47C 7/66 | 297/188.04 X |
| 7,252,329 B1 * | 8/2007 | O'Meally | A47C 7/74 | 297/180.15 X |

* cited by examiner

*Primary Examiner* — Anthony D Barfield
(74) *Attorney, Agent, or Firm* — Ruth Eure

(57) ABSTRACT

A portable beach chair for cooling a person while relaxing or basking in a warm environment is provided. The portable beach chair comprises a chair having a body support portion and a back support portion with the back support portion hingedly connected to the body support portion and releasably securable in a desired angular position. A water reservoir secured to the back support portion holds a predetermined amount of water. A showerhead is fluidly connected to the water reservoir with the showerhead positioned above the back support portion and directing a water flow from the water reservoir in a general direction toward both the body support portion and the back support portion. Upon introducing water through the showerhead from the water reservoir, the water flow through the showerhead cools the person thereby eliminating any need for the person to access a hose or go into a waterbody to cool off.

11 Claims, 3 Drawing Sheets

PORTABLE BEACH CHAIR

CLAIM OF PRIORITY

This patent application claims priority under 35 USC 119 (e) (1) from U.S. Provisional Patent Application Ser. No. 62/319,979 filed Apr. 8, 2016, of common inventorship herewith entitled, "Cool Beach Chair," which is incorporated herein by reference as though the same were set forth in its entirety.

FIELD OF THE INVENTION

The present invention pertains to the field of portable beach chairs, and more specifically to the field of portable beach chairs equipped with a refillable water reservoir and misting shower head to cool a sunbather basking in the hot sun.

BACKGROUND OF THE INVENTION

A day at the beach is a day to be treasured. Whether swimming, surfing, fishing, playing catch or Frisbee with friends or children, or merely lying in the sun and soaking up rays, being next to an ocean exerts a profound and beneficial influence on bodies, minds and spirits, leaving beachgoers both invigorated and relaxed. People who are unable to get to beach can enjoy summer sun in a backyard, on a deck or patio, or in a local park. All that's needed for sunbathing and relaxation is a folding lounge chair, suntan lotion, or sunscreen, and a nice sunny day. For both beachgoers and inland sunbathers, it can become very hot on a bright summer day.

The prior art has put forth several designs for portable beach chairs. Among these are:

U.S. Pat. No. 6,089,655 to Peter Ingalls Colman describes a sunbather misting apparatus comprising a lounge chair having two inverted U shaped arms, each with a front arm support attached to the midsection of the lounge chair seat in proximity to a seated adult's knees. The apparatus also comprises two misting nozzles each attached through the inside forward surface of one chair arm, which together provide complete mist coverage over the lounge chair seat. On and off valves are provided between the nozzles and a pressurized water source to allow for controlled, intermittent flow of water through the nozzles. The apparatus is directly connected to a municipal water source or to a small refillable pump tank supported by the chair. The water conserving configuration of the apparatus also allows multiple chair hookups to a single garden hose. The nozzles and connecting conduits are placed within underside recesses in the lounge chair seat and arms, and become substantially hidden from view during use. Nozzles are positioned in direct opposition to one another to cause mist projected from one nozzle to precisely impact opposing mist so that the sum total of misting fog fans out over the entire length of the lounge chair seat.

US Patent Publication 2012/0223549 to Tony R. Broyles describes a sunbather misting apparatus having a lounge chair having inverted U shaped arms. The apparatus also comprises misting nozzles each attached to the lounger. Misting nozzles are attached to the midsection of the lounger, right and left side, while the others are attached at the foot of the lounger, right and left side, which together provide complete mist coverage over the lounge chair. On and off valves are provided on the right side of the lounger with pressurized water source to allow for controlled, intermittent flow of water misting substantially over the chair.

U.S. Pat. No. 4,765,542 to Daniel R. Carlson describes a manually controlled, self-contained liquid misting attachment for a web covered folding lounge chair and web covered folding chairs useful for sunbathing. A tubular pliable H frame fits the chair frame and is attached by retainers. A pressurized water tank supplies liquid controllably to the H frame and spaced adjustable mist producing heads in paralleling surfaces of the H frame conduits. The sunbather, reclining on a lounge or sitting on a chair to which the liquid misting attachment is fastened, can selectively apply misted water or sun effecting liquids to their body by manually pressurizing a spring biasing normally closed control valve.

None of these prior art references describe the present invention.

SUMMARY OF THE INVENTION

It is an object of the present invention to provide a portable beach chair equipped with a refillable water reservoir and misting shower head to cool a sunbather basking in the hot sun.

A portable beach chair for cooling a person while relaxing or basking in a warm environment. The portable beach chair comprises a chair having a body support portion and a back support portion with the back support portion hingedly connected to the body support portion and releasably securable in a desired angular position. A water reservoir holds a predetermined amount of water with the water reservoir secured to the back support portion. A showerhead is fluidly connected to the water reservoir with the showerhead positioned above the back support portion and directing a water flow from the water reservoir in a general direction toward both the body support portion and the back support portion. Upon introducing water through the showerhead from the water reservoir, the water flow through the showerhead cools the person thereby eliminating any need for the person to access a hose or go into a waterbody to cool off.

In addition, the present invention includes a method for cooling a person while relaxing or basking in a warm environment. The method comprises providing a chair having a body support portion and a back support portion, hingedly connecting the back support portion to the body support portion, releasably securing the back support portion relative to the body support portion in a desired angular position, securing a water reservoir to the back support portion, introducing a predetermined amount of water into the water reservoir, fluidly connecting a showerhead to the water reservoir, positioning the showerhead above the back support portion, directing a water flow from the water reservoir in a general direction toward both the body support portion and the back support portion, cooling the person, and eliminating any need for the person to access a hose or go into a waterbody to cool off.

The present invention further includes a portable beach chair for cooling a person while relaxing or basking in a warm environment. The portable beach chair comprises a chair having a body support portion and a back support portion with the back support portion hingedly connected to the body support portion and releasably securable in a desired angular position. At least one support leg extends from the body support portion for supporting chair above a ground surface. A pair of armrests is mounted to and extends above the body support portion. A footrest extends from the body support portion of the chair with the footrest hingedly secured to the body support portion and releasably securable at a desired angle relative to the body support portion. A water reservoir holds a predetermined amount of water with the water reservoir secured to the back support portion. An adjustable showerhead is fluidly connected to the water reservoir with the showerhead positioned above the back support portion and directing a water flow from the water reservoir in a general direction toward both the body support portion and the back support portion. The body support portion, the back support portion, the at least one support leg, the pair of armrests, and the footrest are foldable into a compact, portable state for storage and transportation. Upon introducing water through the showerhead from the water reservoir, the water flow through the showerhead cools the person thereby eliminating any need for the person to access a hose or go into a waterbody to cool off.

DETAILED DESCRIPTION OF THE INVENTION

Figure 1:
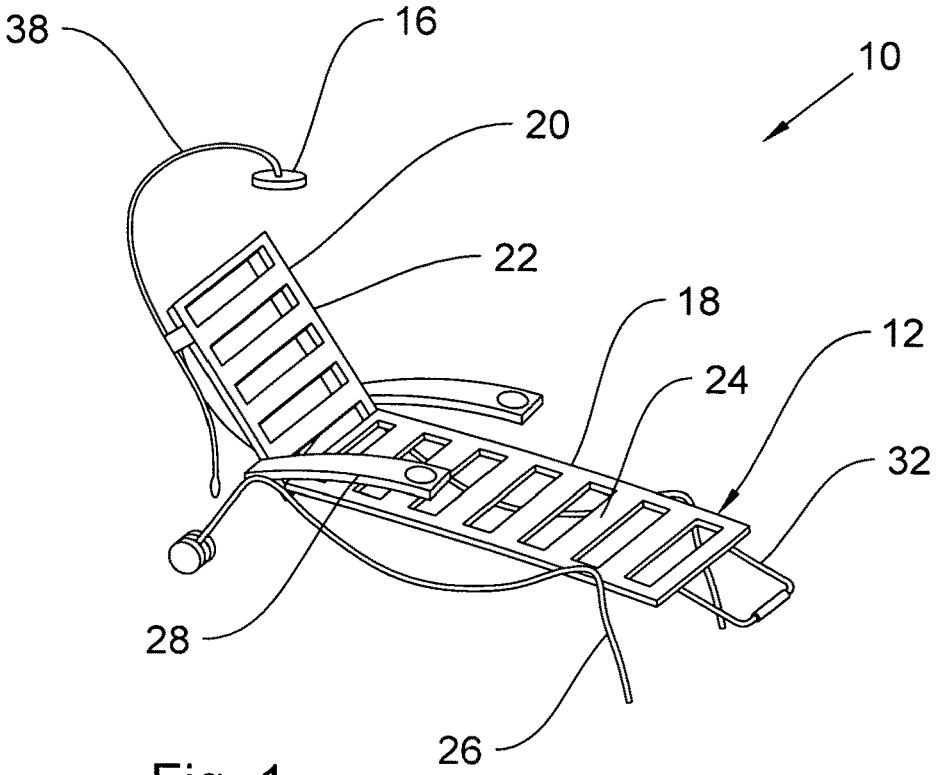
FIG. 1 is a perspective view illustrating a portable beach chair, constructed in accordance with the present invention, with the beach chair in a reclining position and showing a sturdy frame, strap covering over the frame, support legs, a foot rest, wide armrests with cup holders, and a backpack with a water reservoir and a connected hose that attaches to a vertical shower pole and showerhead.
Figure 2:
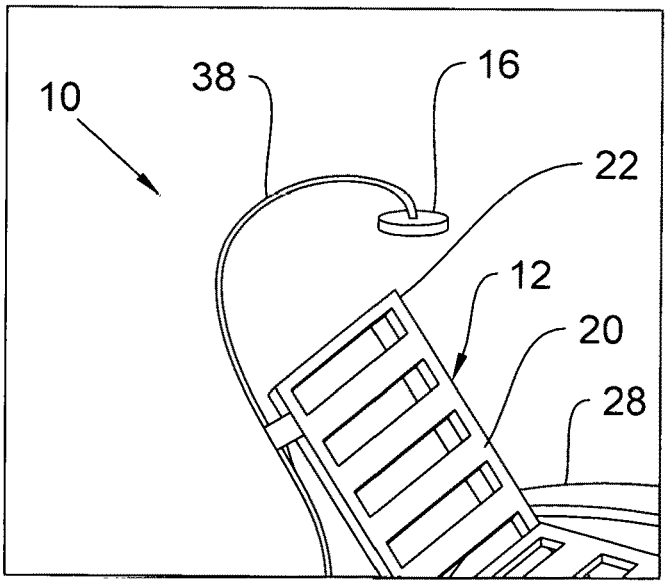
FIG. 2 is a perspective view illustrating a front side of a back support portion of the portable beach chair, constructed in accordance with the present invention, showing the strap covering, the armrests, attached backpack, and connected shower pole and showerhead.
Figure 3:
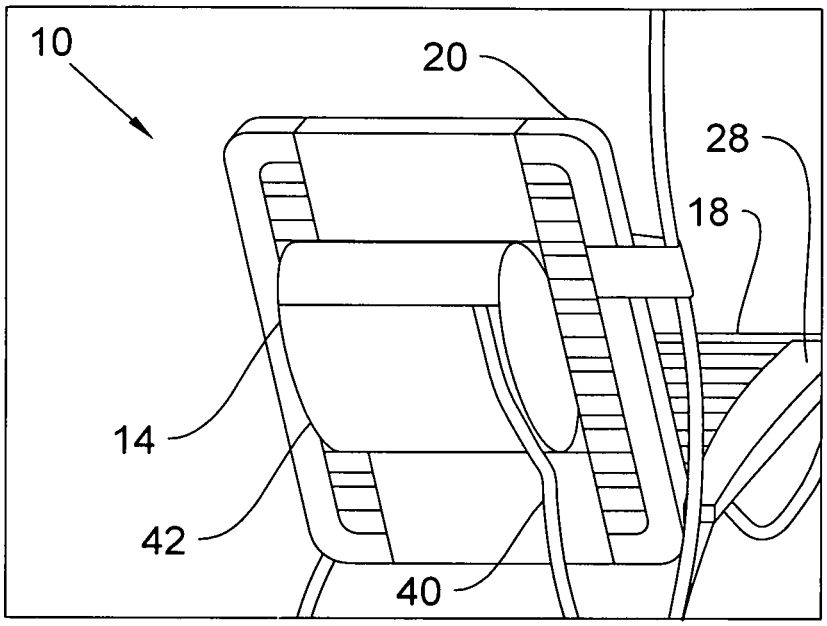
FIG. 3 is a perspective view illustrating of a rear side of the back support portion of the portable beach chair, constructed in accordance with the present invention, showing the backpack with a water reservoir and the hose that connects upward into the pole of the overhead showerhead.
Figure 4:
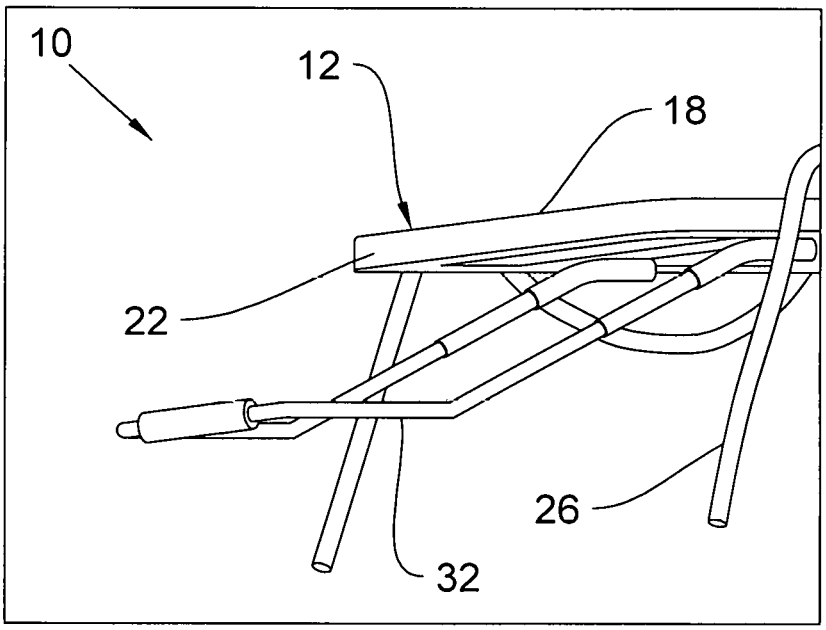
FIG. 4 is a perspective view illustrating an adjustable footrest of the portable beach chair, constructed in accordance with the present invention, showing how the footrest extends outward from underneath the distal end of the present invention.
Figure 5:
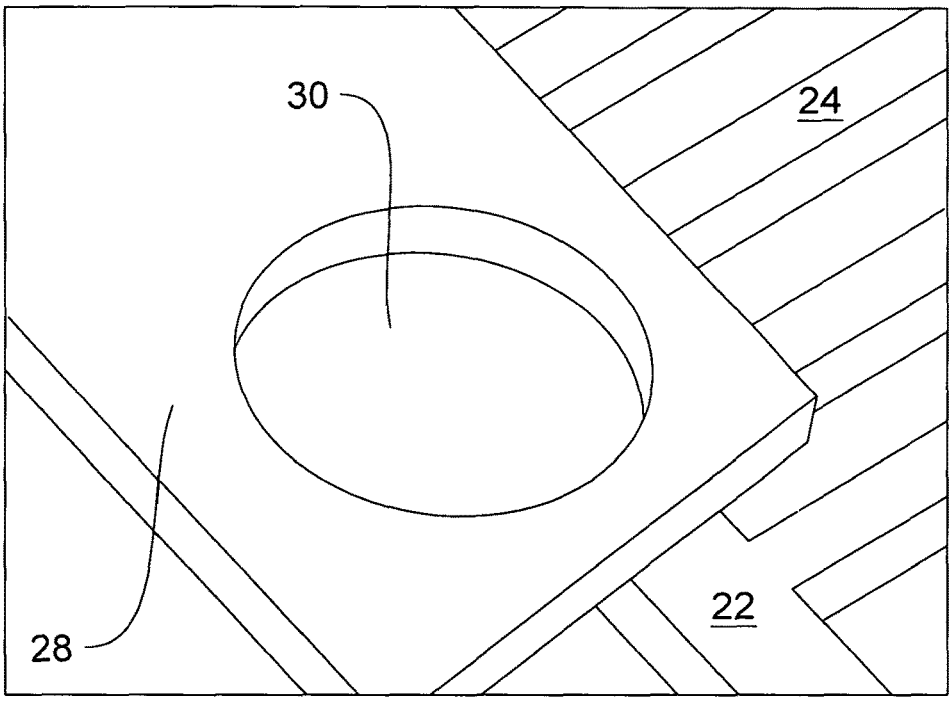
FIG. 5 is a perspective view illustrating the armrest of the portable beach chair, constructed in accordance with the present invention, showing a recessed cup holder in the front portion of the armrest.
Figure 6:
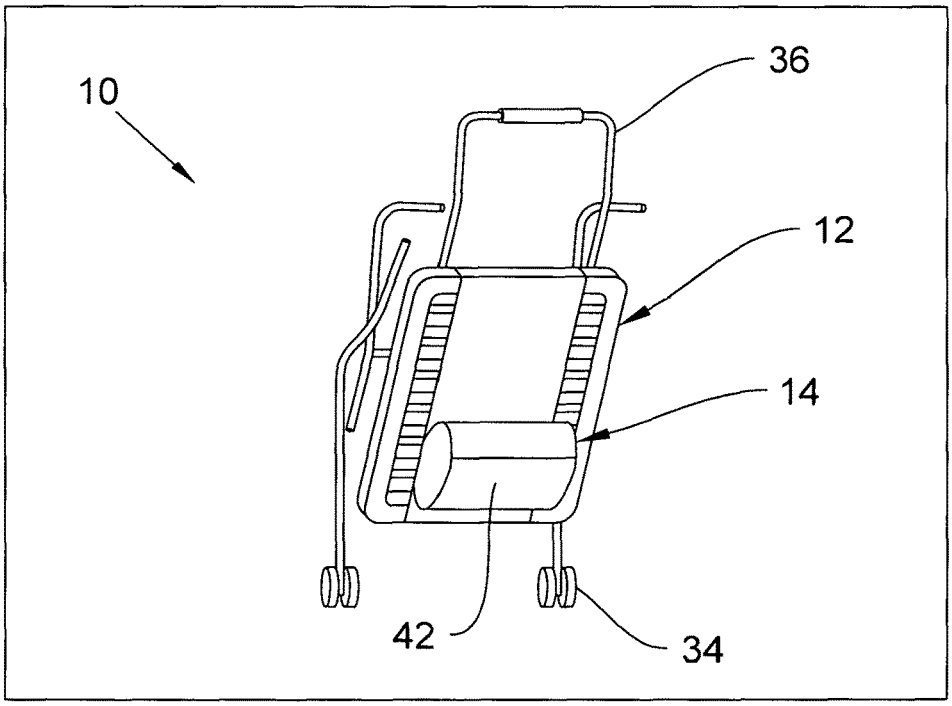
FIG. 6 is a perspective view of the portable beach chair, constructed in accordance with the present invention, folded into a compacted position for easily wheeled portability and storage.

The present invention, hereinafter referred to as a Portable Beach Chair, indicated generally at 10, is an adjustable chaise lounge 12 that is equipped with a refillable water reservoir 14 and misting shower head 16 to cool a sunbather basking in the hot sun. The Portable Beach Chair 10 is a high quality, lightweight and portable, folding chaise lounge 12 intended specifically for outdoor use.

The Portable Beach Chair 10 of the present invention includes a chair 12 having a body support portion 18 for supporting the lower portion of a person and a back support portion 20 for supporting the upper portion of the person. In a preferred embodiment, the back support portion 20 is hingedly connected to the body support portion 18 and releasably securable in a desired angular position. The hinge connection allows the back support portion 20 to move from a first position substantially horizontal to the body support portion 18 (fully prone or supine) to a second position substantially perpendicular to the body support portion 20 (upright). In other embodiments, the chair 12 can include more portions than the body support portion 18 and the back support portion 20 and each of the body support portion 18 and the back support portion 20 can include multiple sections.

Preferably, the body support portion 18 and the back support portion 20 of the chair 12 of the Portable Beach Chair 10 of the present invention each include a frame 22 with a chair material 24 stretched between the frame 22 and support legs 26 extending from the frame 22 to support the chair 12 above the ground. The chair material 24 includes, but not limited to, water resistant canvas, plastic webbing, and plastic strapping.

In addition, the chair 12 of the Portable Beach Chair 10 of the present invention includes two armrests 28. Preferably, each armrest 28 is constructed from a moldable plastic material. Each armrest 28 is preferably equipped with a recessed cup holder 30.

Furthermore, the chair 12 of the Portable Beach Chair 10 of the present invention includes a footrest 32 extending from the body support portion 18 of the chair 12. The footrest 32 can be hingedly secured to the body support portion 18 and releasably securable at a desired angle relative to the body support portion 18. The Portable Beach Chair 10 including the body support portion 18, the back support portion 20, the support legs 26, and the footrest 32 are foldable into a relatively compact, easily portable state for storage and transportation. With a two-wheeled trolley configuration 34 and an adjustable handle 36, the chair 12 of the Portable Beach Chair 10 is easily pushed and pulled much like a wheeled suitcase when in its folded, compact state.

Furthermore, the Portable Beach Chair 10 of the present invention includes a maneuverable, multi-positionable, misting showerhead 16 supported by a shower pole 38 connected to the back support portion 20 of the chair 12. The showerhead is fluidly connected by plastic tubing 40, hosing, or the like to a refillable water reservoir 14 held within a compartmented backpack 42 detachably mounted to the back support portion 20 of the chair 12 by means of a zippered storage pouch or backpack 42. The water reservoir 14 is filled with cool water, and the misting showerhead 16 delivers, on demand, a misting spray that can cover one's entire body or simply one's upper body and head.

The showerhead 16 of the Portable Beach Chair 10 is engineered to cool a user with a refreshing spray mist, and eliminates any need for a person to access a hose or go into the water to cool off. The shower function of the Portable Beach Chair 10 is provided by a simple, squeeze activated, trigger pump, or by a battery powered electric pump delivering water from the water reservoir 14 to the showerhead 16. The shower components are easily detached, if necessary, for transport and storage.

The backpack 42 of the Portable Beach Chair 10 of the present invention includes storage for personal accessories. In this manner, the backpack 42 contains accessory pockets for storing one's smartphone, E reader, and sunglasses, for example.

A sturdy lounger for dedicated sun worshipers, the Portable Beach Chair 10 of the present invention is highly functional for use at a beach, in the backyard, or on camping excursions. Constructed of lightweight materials, the Portable Beach Chair 10 provides portable, supportive and stable comfort to the user. Durably constructed of high quality materials and components, the Portable Beach Chair 10 will provide many years of continued use.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A portable beach chair for cooling a person while relaxing or basking in a warm environment, the portable beach chair comprising:

a chair having a body support portion and a back support portion, the back support portion hingedly connected to the body support portion and releasably securable in a desired angular position;

a water reservoir for holding a predetermined amount of water, the water reservoir secured to the back support portion; and a compartmented backpack detachably mounted to the back support portion of the chair, the backpack releasably holding the water reservoir, a showerhead fluidly connected to the water reservoir, the showerhead positioned above the back support portion and directing a water flow from the water reservoir in a general direction toward both the body support portion and the back support portion;

a tubing fluidly connecting the water reservoir to the showerhead, wherein upon introducing water through the showerhead from the water reservoir, the water flow through the showerhead cools the person thereby eliminating any need for the person to access a hose or go into a waterbody to cool off.

2. The portable beach chair of claim 1 wherein the back support portion is capable of moving from a first position substantially horizontal to the body support portion (fully prone or supine) to a second position substantially perpendicular to the body support portion (upright).

3. The portable beach chair of claim 1 wherein the body support portion and the back support portion of the chair each include a frame with a chair material stretched between the frame.

4. The portable beach chair of clam 1 and further comprising:

at least one support leg extending from the body support portion for supporting the chair above a ground surface.

5. The portable beach chair of claim 1 and further comprising:

a pair of armrests mounted to and extending above the body support portion of the chair; and a recessed cup holder formed in each armrest.

6. The portable beach chair of claim 1 and further comprising:

a footrest extending from the body support portion of the chair, the footrest hingedly secured to the body support portion and releasably securable at a desired angle relative to the body support portion.

7. The portable beach chair of claim 1 wherein the body support portion and the back support portion are foldable into a compact, portable state for storage and transportation.

8. The portable beach chair of clay 1 and further comprising:

a pair of wheels secured to the body support portion of the chair; and an adjustable handle extending from the body support portion.

9. The portable beach chair of claim 1 wherein the directional water flow of the showerhead is adjustable.

10. The portable beach chair of claim 1 wherein the showerhead is supported by a shower pole connected to the back support portion of the chair.

11. The portable beach chair of claim 1 and further comprising:

a water activation mechanism for delivering water from the water reservoir to the showerhead.

* * * * *